US011131957B2

(12) United States Patent
Ichikawa

(10) Patent No.: US 11,131,957 B2
(45) Date of Patent: Sep. 28, 2021

(54) IMAGE FORMING APPARATUS INCLUDING DEVELOPING CARTRIDGE, TONER CONTAINER, AND SUPPLY TUBE

(71) Applicant: BROTHER KOGYO KABUSHIKI KAISHA, Nagoya (JP)

(72) Inventor: Tomoya Ichikawa, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/984,103

(22) Filed: Aug. 3, 2020

(65) Prior Publication Data

US 2020/0363767 A1 Nov. 19, 2020

Related U.S. Application Data

(63) Continuation of application No. 16/426,735, filed on May 30, 2019, now Pat. No. 10,788,784.

(30) Foreign Application Priority Data

May 30, 2018 (JP) ..... JP2018-103337

(51) Int. Cl.
*G03G 21/16* (2006.01)
*G03G 21/18* (2006.01)

(52) U.S. Cl.
CPC ..... *G03G 21/1623* (2013.01); *G03G 21/1676* (2013.01); *G03G 21/1821* (2013.01)

(58) Field of Classification Search
CPC ..... G03G 15/0877; G03G 15/0886; G03G 21/1623; G03G 21/1642; G03G 21/1676
See application file for complete search history.

(56) References Cited

U.S. PATENT DOCUMENTS

| | | | |
|---|---|---|---|
| 2009/0297209 | A1 | 12/2009 | Nakajima et al. |
| 2010/0080615 | A1 | 4/2010 | Kikuchi |
| 2011/0164897 | A1 | 7/2011 | Kikuchi |
| 2011/0182612 | A1 | 7/2011 | Kamimura et al. |
| 2011/0182613 | A1 | 7/2011 | Kamimura et al. |

(Continued)

FOREIGN PATENT DOCUMENTS

| | | | |
|---|---|---|---|
| JP | 2011-150177 | A | 8/2011 |
| JP | 2011-150178 | A | 8/2011 |
| JP | 2011-186067 | A | 9/2011 |

(Continued)

*Primary Examiner* — Walter L Lindsay, Jr.
*Assistant Examiner* — Andrew V Do
(74) *Attorney, Agent, or Firm* — Kenealy Vaidya LLP

(57) ABSTRACT

An image forming apparatus including: a main body housing; a drawer; a developing cartridge detachably supported by the drawer; a toner container configured to be mounted to and demounted from the main body housing; and a supply tube being movable between a connection position at which the supply tube is connected to the developing cartridge and is capable of supplying toner from the toner container to the developing cartridge supported by the drawer and a non-connection position at which the supply tube is not connected to the developing cartridge, wherein in a case where the drawer is moved from an inner position to an outer position in a state where the developing cartridge is supported by the drawer, the supply tube comes into contact with a part of the developing cartridge and is thus moved from the connection position to the non-connection position.

12 Claims, 10 Drawing Sheets

(56) References Cited

U.S. PATENT DOCUMENTS

| | | | |
|---|---|---|---|
| 2011/0217068 | A1 | 9/2011 | Kamimura et al. |
| 2018/0028632 | A1 | 2/2018 | Chen |

FOREIGN PATENT DOCUMENTS

| | | | |
|---|---|---|---|
| JP | 2011-221562 | A | 11/2011 |
| JP | 2012-137798 | A | 7/2012 |
| JP | 2013-029755 | A | 2/2013 |

IMAGE FORMING APPARATUS INCLUDING DEVELOPING CARTRIDGE, TONER CONTAINER, AND SUPPLY TUBE

CROSS-REFERENCE TO RELATED APPLICATIONS

This application claims priority under 35 U.S.C. § 120 as a Continuation of U.S. application Ser. No. 16/426,735 filed on May 30, 2019, which in claims priority under 35 U.S.C. § 119 from Japanese Patent Application No. 2018-103337 filed on May 30, 2018, the entire contents of which are incorporated herein by reference.

TECHNICAL FIELD

The present disclosure relates to and image forming apparatus.

BACKGROUND ART

In related art, an image forming apparatus includes a main body housing, a drawer, a process unit, a toner container and a shutter.

The drawer is movable between an inner position located inside the main body housing and an outer position located outside the main body housing. The process unit includes a photosensitive drum and a developing roller, and is detachably supported by the drawer. The toner container is configured to be mounted to and demounted from the main body housing and is capable of accommodating therein toner. The toner in the toner container is supplied to the process unit in a state where the process unit is mounted to the drawer and the drawer is located at the inner position. The shutter is located at a closing position at which discharge of the toner from the toner container is blocked in a state where the drawer is located at the outer position, and is located at an opening position at which supply of the toner from the toner container to the process unit is allowed in a state where the drawer is located at the inner position. The shutter is moved from the opening position to the closing position in conjunction with movement of the drawer from the inner position to the outer position, and is moved from the closing position to the opening position in conjunction with movement of the drawer from the outer position to the inner position.

SUMMARY

According to an aspect of the present disclosure, there is provided an image forming apparatus. The image forming apparatus may include a main body housing, a drawer, a developing cartridge, a toner container, and a supply tube. The drawer may be movable in a moving direction between an inner position located inside the main body housing and an outer position located outside the main body housing. The developing cartridge may be detachably supported by the drawer and include a developing roller. The toner container may be configured to be mounted to and demounted from the main body housing and may be capable of accommodating therein toner. The supply tube may be configured to supply the toner from the toner container to the developing cartridge supported by the drawer. The supply tube may be movable between a connection position at which the supply tube is connected to the developing cartridge and may be capable of supplying the toner from the toner container and a non-connection position at which the supply tube is not connected to the developing cartridge. In a case where the drawer is moved from the inner position to the outer position in a state where the developing cartridge is supported by the drawer, the supply tube may come into contact with a part of the developing cartridge and thus move from the connection position to the non-connection position.

DETAILED DESCRIPTION

1. Outline of Image Forming Apparatus 1

Figure 1:
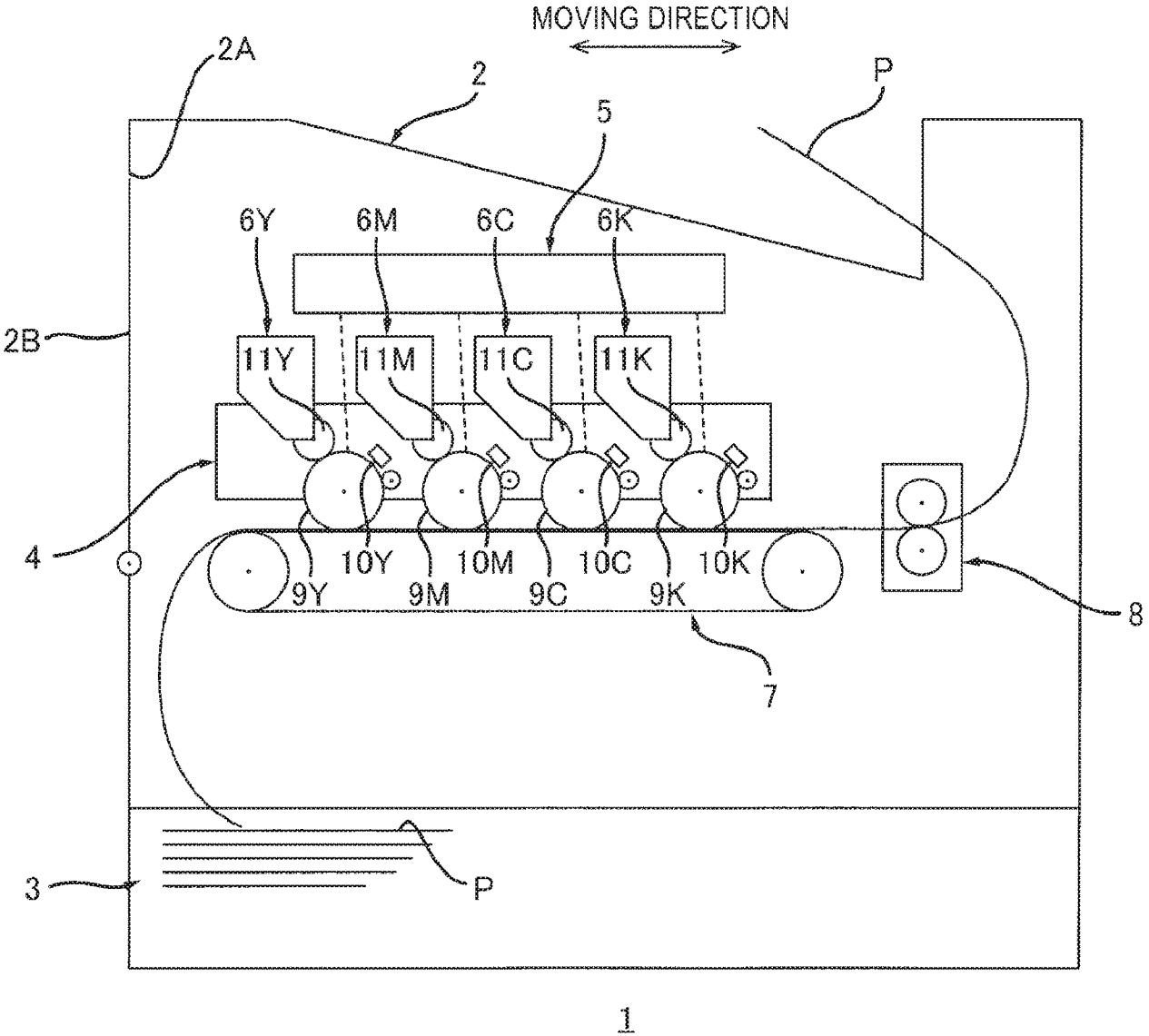
FIG. 1 is a schematic configuration view of an image forming apparatus.
Figure 2:
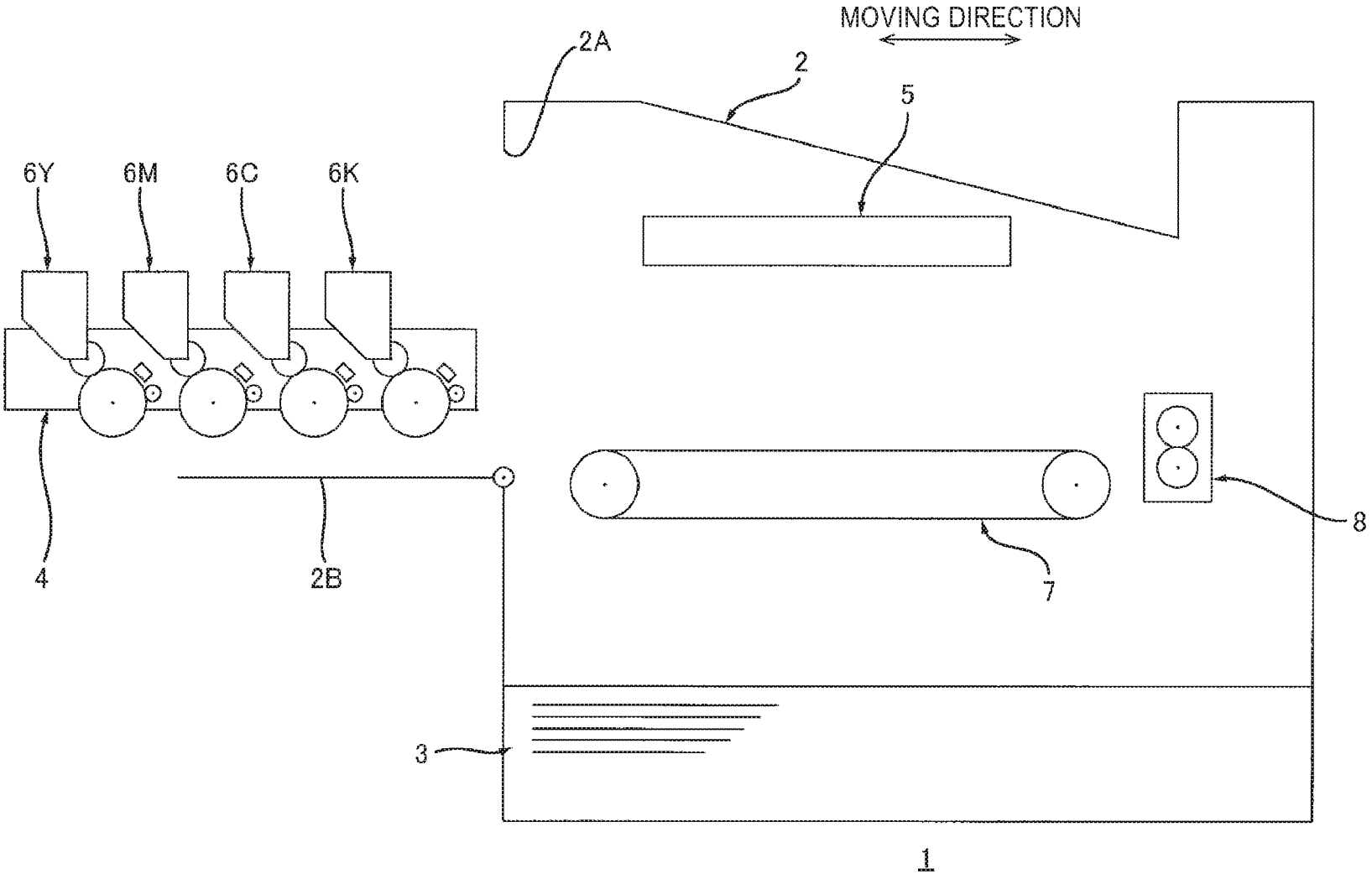
FIG. 2 is a view illustrating the image forming apparatus shown in FIG. 1, depicting a state where a drawer is located at an outer position.

Referring to FIGS. 1 and 2, an outline of an image forming apparatus 1 is described.

As shown in FIG. 1, the image forming apparatus 1 includes a main body housing 2, a sheet feeding tray 3, a drawer 4, an exposure device 5, four developing cartridges 6Y, 6M, 6C, 6K, a transfer device 7, and a fixing device 8.

1.1 Main Body Housing

The main body housing 2 configures an exterior package of the image forming apparatus 1. The main body housing 2 is configured to accommodate therein the sheet feeding tray 3, the drawer 4, the exposure device 5, the four developing cartridges 6Y, 6M, 6C, 6K, the transfer device 7, and the fixing device 8. The main body housing 2 has an opening 2A and a cover 2B.

The cover 2B is movable between an opening position (see FIG. 2) and a closing position (see FIG. 1). In a state where the cover 2B is located at the opening position, the cover 2B opens the opening 2A. In a state where the cover 2B is located at the closing position, the cover 2B closes the opening 2A.

1.2 Sheet Feeding Tray

In the sheet feeding tray 3, a printing medium P is accommodated. The printing medium P in the sheet feeding tray 3 is conveyed toward a photosensitive drum 9Y. The printing medium P is a printing sheet, for example. The photosensitive drum 9Y will be described later.

1.3 Drawer

The drawer 4 is movable in a moving direction between an inner position (see FIG. 1) and an outer position (see FIG. 2). In a state where the drawer 4 is located at the inner position, the drawer 4 is located inside the main body housing 2. In a state where the drawer 4 is located at the outer position, the drawer 4 is located outside the main body housing 2. In the state where the cover 2B is located at the opening position, in a case where the drawer 4 is moved between the inner position and the outer position, the drawer 4 passes through the opening 2A. The drawer 4 includes four photosensitive drums 9Y, 9M, 9C, 9K and four chargers 10Y, 10M, 10C, 10K.

The four photosensitive drums 9Y, 9M, 9C, 9K are aligned side by side in the moving direction of the drawer 4. The photosensitive drum 9Y is configured to be rotatable relative to a rotational axis extending in an axial direction. The axial direction intersects with the moving direction of the drawer 4. Preferably, the axial direction is perpendicular to the moving direction of the drawer 4. The photosensitive drum 9Y extends in the axial direction, and has a cylindrical shape. Since descriptions of the photosensitive drums 9M, 9C, 9K are the same as the description of the photosensitive drum 9Y, the descriptions thereof are omitted.

The charger 10Y is configured to charge a peripheral surface of the photosensitive drum 9Y. The charger 10M is configured to charge a peripheral surface of the photosensitive drum 9M. The charger 10C is configured to charge a peripheral surface of the photosensitive drum 9C. The charger 10K is configured to charge a peripheral surface of the photosensitive drum 9K. Each of the four chargers 10Y, 10M, 10C, 10K is, specifically, a scorotron-type charger. In the meantime, each of the four chargers 10Y, 10M, 10C, 10K may be a charging roller.

1.4 Exposure Device

The exposure device 5 is configured to expose the photosensitive drum 9Y. Specifically, the exposure device 5 is configured to expose the peripheral surface of the photosensitive drum 9Y by irradiating the peripheral surface the photosensitive drum 9Y, which has been charged by the charger 10Y, with light. Thereby, an electrostatic latent image is formed on the peripheral surface the photosensitive drum 9Y. The exposure device 5 is, specifically, a laser scan unit configured to scan the peripheral surface the photosensitive drum 9Y with laser light. In the meantime, the exposure device 5 may be an LED unit having an LED array. The exposure device 5 is configured to also expose the photosensitive drums 9M, 9C, 9K.

1.5 Four Developing Cartridges

Each of the four developing cartridges 6Y, 6M, 6C, 6K is detachably supported by the drawer 4. Specifically, the drawer 4 is movable between the inner position and the outer position while supporting the four developing cartridges 6Y, 6M, 6C, 6K. Each of the four developing cartridges 6Y, 6M, 6C, 6K can be mounted to and demounted from the drawer 4 in the state where the drawer 4 is located at the outer position. Each of the four developing cartridges 6Y, 6M, 6C, 6K is capable of accommodating therein toner. Specifically, each of the four developing cartridges 6Y, 6M, 6C, 6K accommodates therein the toner in a non-use state. The developing cartridge 6Y includes a developing roller 11Y.

The developing roller 11Y is configured to be rotatable about a rotational axis extending in the axial direction. The developing roller 11Y is in contact with the peripheral surface of the photosensitive drum 9Y in a state where the developing cartridge 6Y is mounted to the drawer 4. The developing roller 11Y is capable of supplying the toner in the developing cartridge 6Y to the peripheral surface of the photosensitive drum 9Y. The developing roller 11Y extends in the axial direction and has a circular column shape.

The developing cartridge 6M includes a developing roller 11M, the developing cartridge 6C includes a developing roller 11C, and the developing cartridge 6K includes a developing roller 11K. Since descriptions of the developing rollers 11M, 11C, 11K are the same as the description of the developing roller 11Y, the descriptions are omitted.

1.6 Transfer Device

The transfer device 7 is configured to transfer the printing medium P from the sheet feeding tray 3 toward the fixing device 8. The printing medium P conveyed by the transfer device 7 passes between the transfer device 7 and the four photosensitive drums 9Y, 9M, 9C, 9K. At this time, the transfer device 7 is configured to transfer toner images formed on the four photosensitive drums 9Y, 9M, 9C, 9K to the printing medium P.

1.7 Fixing Device

The fixing device 8 is configured to heat and press the printing medium P having the toner images transferred thereto, thereby fixing the toner images on the printing medium P. The printing medium P having passed through the fixing device 8 is discharged onto an upper surface of the main body housing 2.

2. Details of Image Forming Apparatus 1

Subsequently, the image forming apparatus 1 is described in detail with reference to FIGS. 3 to 10B.

Figure 10A:
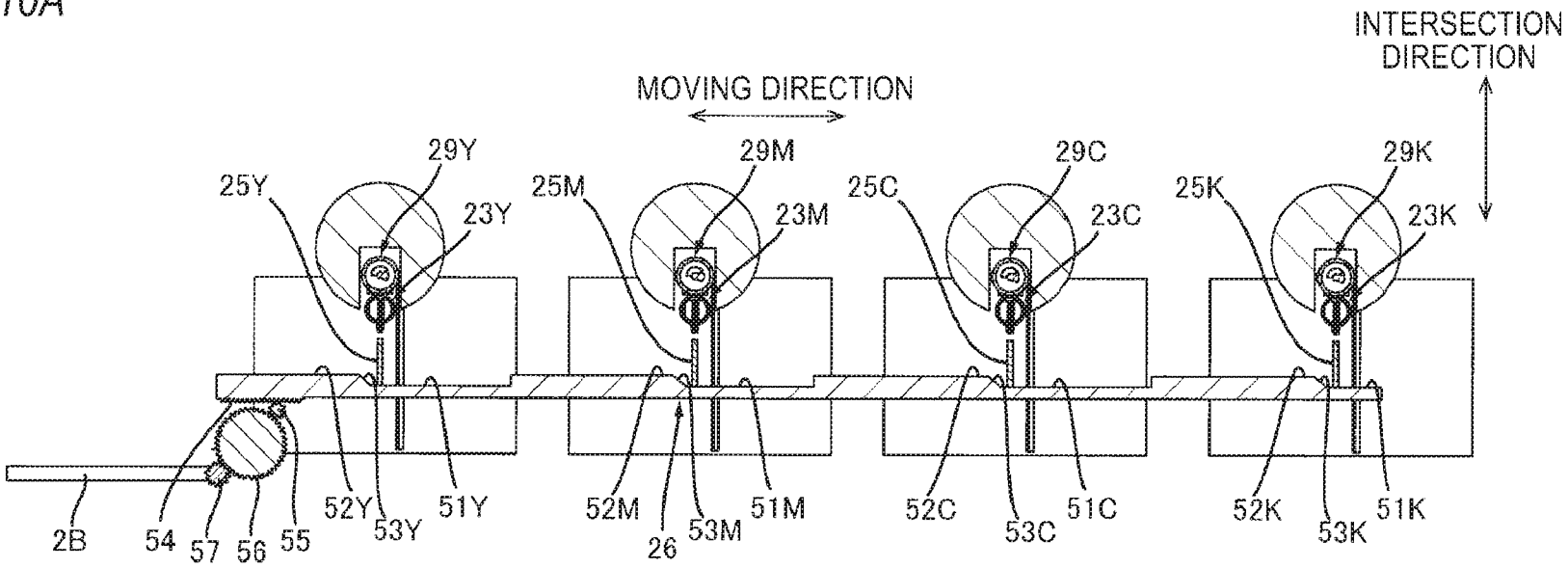
FIG. 10A illustrates interlocking of a cover and a lock releasing member, depicting a state where the cover is located at an opening position, a cam is located at a first position and the lock releasing member is located at a spaced position.

The image forming apparatus 1 includes four toner containers 21Y, 21M, 21C, 21K (see FIG. 3), four supply tubes 22Y, 22M, 22C, 22K (see FIG. 6), four support members 23Y, 23M, 23C, 23K (see FIG. 6), four pressing members 24Y, 24M, 24C, 24K (see FIG. 6), four lock releasing members 25Y, 25M, 25C, 25K (see FIG. 10A), and a cam 26 (see FIG. 10A).

Here, the four toner containers 21Y, 21M, 21C, 21K have the same structure, respectively, the four supply tubes 22Y, 22M, 22C, 22K have the same structure, respectively, the four support members 23Y, 23M, 23C, 23K have the same structure, respectively, the four pressing members 24Y, 24M, 24C, 24K have the same structure, respectively, and the four lock releasing members 25Y, 25M, 25C, 25K have the same structure, respectively. For this reason, in the below, the toner container 21Y, the supply tube 22Y, the support member 23Y, the pressing member 24Y and the lock releasing member 25Y will be described in detail, and the descriptions of the toner containers 21M, 21C, 21K, the supply tubes 22M, 22C, 22K, the support members 23M, 23C, 23K, the pressing members 24M, 24C, 24K and the lock releasing members 25M, 25C, 25K will be omitted.

2.1 Toner Container

Figure 3:
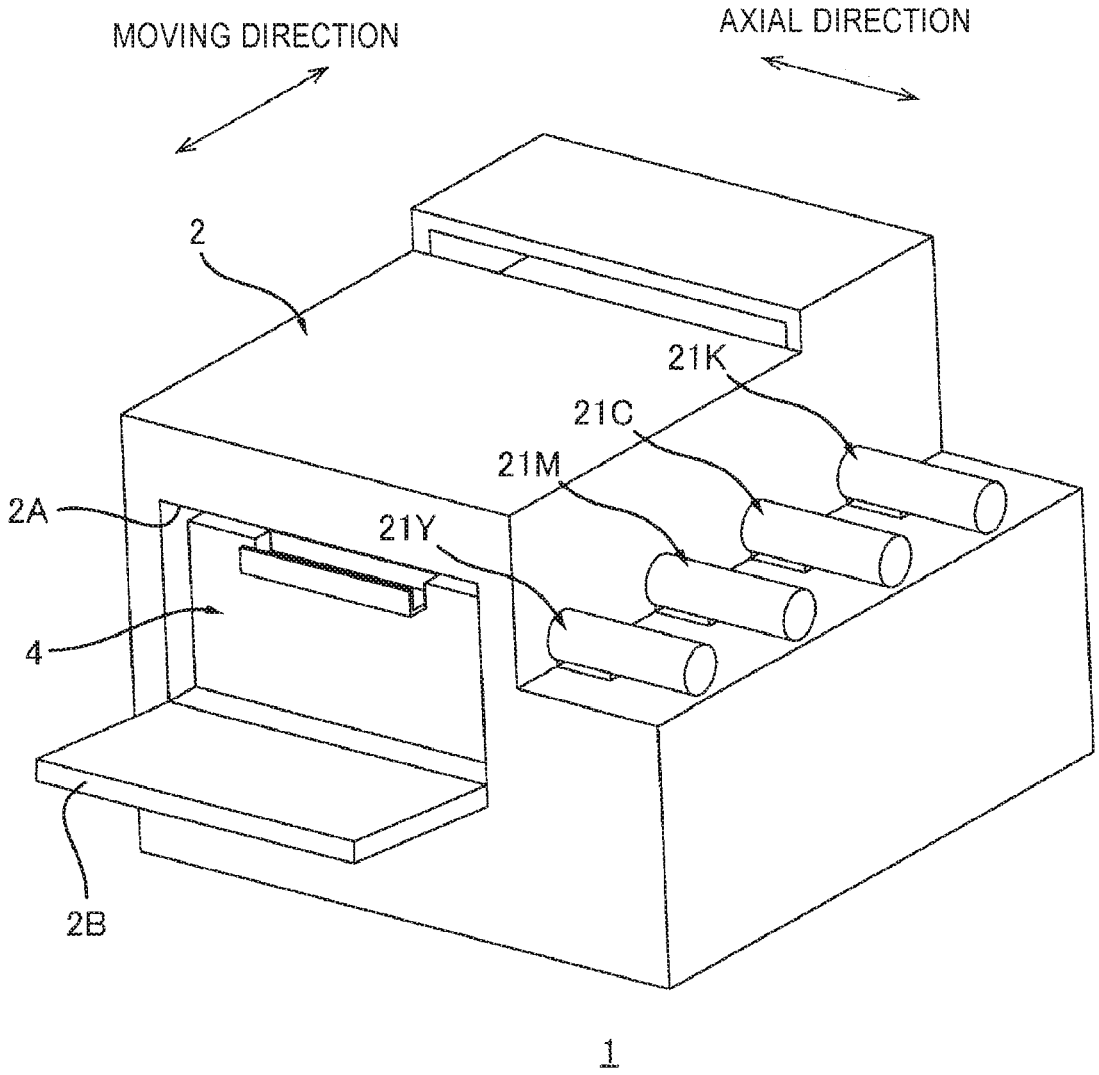
FIG. 3 is a perspective view of the image forming apparatus shown in FIG. 1.

As shown in FIG. 3, the four toner containers 21Y, 21M, 21C, 21K are aligned side by side in the moving direction of the drawer 4. Each of the four toner containers 21Y, 21M, 21C, 21K can be mounted to and demounted from the main body housing 2 and is capable of accommodating therein the toner.

Figure 4:
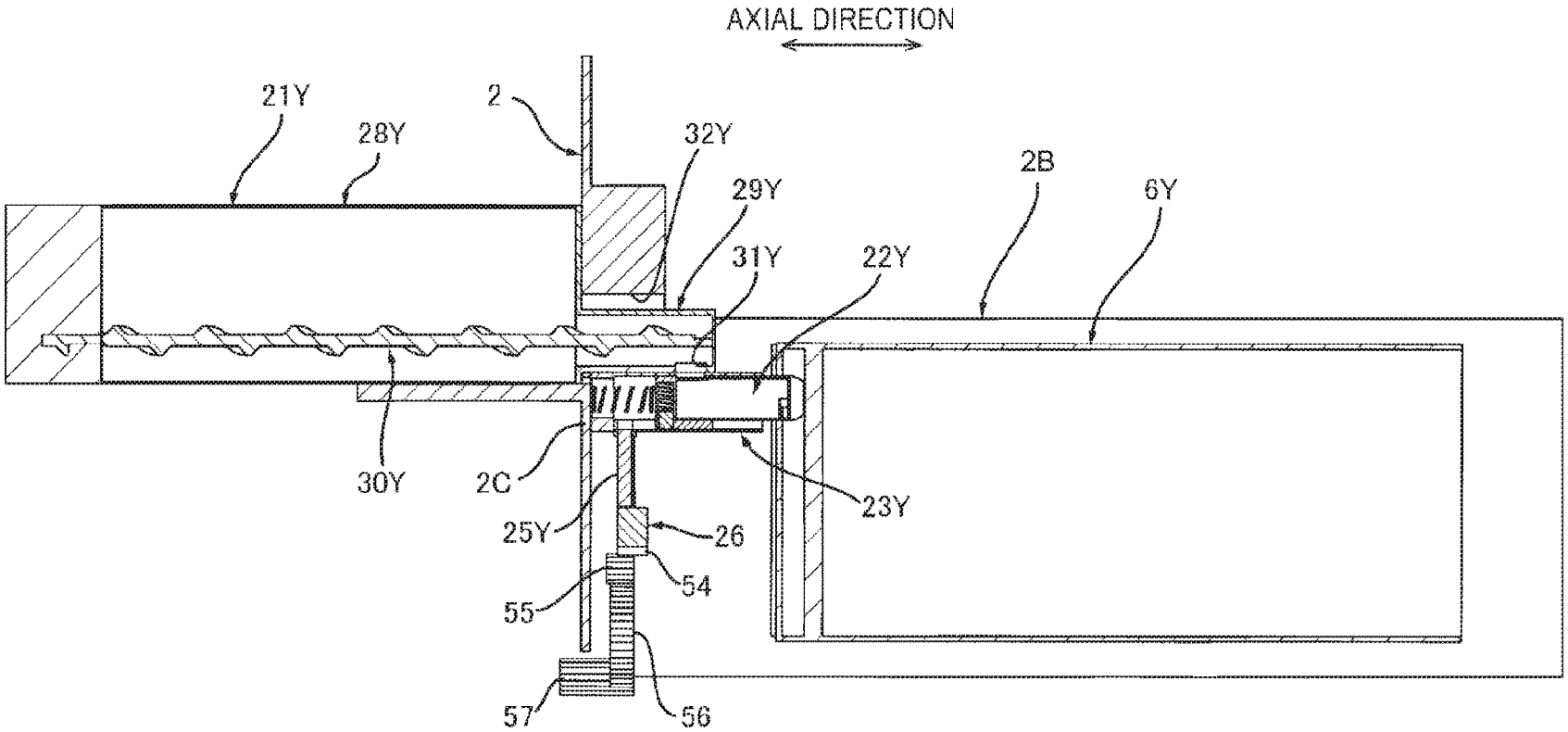
FIG. 4 illustrates movement of a supply tube depicting a state where the supply tube is located at a connection position, and is a sectional view taken along a line A-A of FIG. 6.

As shown in FIG. 4, the toner container 21Y includes an accommodation part 28Y, a supply part 29Y and a screw 30Y.

The accommodation part 28Y extends in the axial direction. The accommodation part 28Y has a cylindrical shape. The accommodation part 28Y is located outside the main body housing 2 in a state where the toner container 21Y is mounted to the main body housing 2. The accommodation part 28Y accommodates therein the toner.

The supply part 29Y extends from the accommodation part 28Y. An internal space of the supply part 29Y communicates with an internal space of the accommodation part 28Y. The supply part 29Y extends in the axial direction. The supply part 29Y has a cylindrical shape. The supply part 29Y is located inside the main body housing 2 in the state where the toner container 21Y is mounted to the main body housing 2. The supply part 29Y has a discharge hole 31Y.

The discharge hole 31Y is provided at a part of a peripheral wall of the supply part 29Y. The discharge hole 31Y is a through-hole. The discharge hole 31Y communicates with the internal space of the supply part 29Y. The toner introduced from the accommodation part 28Y into the supply part 29Y is discharged from the discharge hole 31Y. That is, the discharge hole 31Y is formed to discharge the toner accommodated in the accommodation part 28Y. In a state where the toner container 21Y is mounted to the main body housing 2 and the supply tube 22Y is located at a connection position, the toner discharged from the discharge hole 31Y is introduced into the supply tube 22Y through a communication hole 47Y (see FIG. 7) of the support member 23Y and a receiving hole 41Y (see FIG. 7) of the supply tube 22Y. Thereby, the supply part 29Y supplies the toner accommodated in the accommodation part 28Y to the supply tube 22Y. The communication hole 47Y and the receiving hole 41Y will be described later.

The screw 30Y is located in the toner container 21Y. The screw 30Y extends in the axial direction. The screw 30Y extends from the accommodation part 28Y to the discharge hole 31Y. Thereby, the screw 30Y can convey the toner in the accommodation part 28Y to the discharge hole 31Y. The screw 30Y is, specifically, an auger screw.

2.2 Supply Tube

As shown in FIG. 4, the supply tube 22Y is supported by the support member 23Y. The supply tube 22Y is supported by an inner wall 2C of the main body housing 2 in the axial direction, via the support member 23Y. That is, the main body housing 2 includes the supply tube 22Y. In the meantime, the inner wall 2C has four through-holes 32Y (see FIG. 4), 32M, 32C, 32K. The through-holes 32M, 32C, 32K are not shown. The supply part 29Y of the toner container 21Y is inserted in the through-hole 32Y, the supply part 29M of the toner container 21M is inserted in the through-hole 32M, the supply part 29C of the toner container 21C is inserted in the through-hole 32C, and the supply part 29K of the toner container 21K is inserted in the through-hole 32K.

Figure 5:
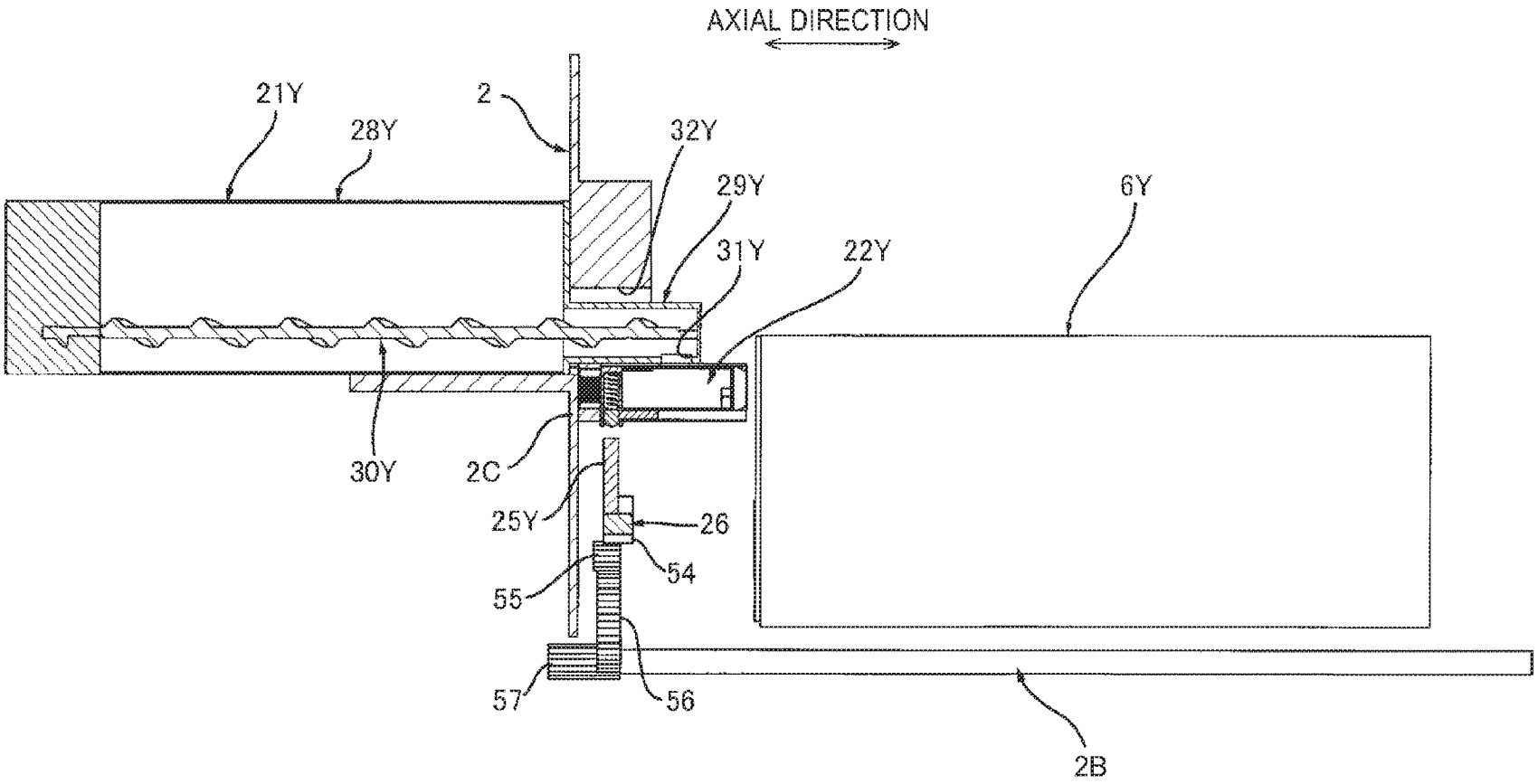
FIG. 5 illustrates movement of the supply tube together with FIG. 4, depicting a state where the supply tube is located at a non-connection position.

The supply tube 22Y is movable in the axial direction between a connection position (see FIG. 4) and a non-connection position (see FIG. 5). As shown in FIG. 4, in a state where the drawer 4 supporting the developing cartridge 6Y is located at the inner position and the supply tube 22Y is located at the connection position, the supply tube 22Y is connected to the developing cartridge 6Y supported by the drawer 4. In this state, the supply tube 22Y supplies the toner from the toner container 21Y to the developing cartridge 6Y supported by the drawer 4. That is, the supply tube 22Y is capable of supplying the toner from the toner container 21Y to the developing cartridge 6Y. Also, as shown in FIG. 5, in a state where the supply tube 22Y is located at the non-connection position, the supply tube 22Y is not connected to the developing cartridge 6Y. In this state, the supply tube 22Y cannot supply the toner from the toner container 21Y to the developing cartridge 6Y.

In a case where the drawer 4 is moved from the inner position to the outer position in the state where the developing cartridge 6Y is supported by the drawer 4, the supply tube 22Y comes into contact with a part of the developing cartridge 6Y and is thus moved from the connection position to the non-connection position.

Figure 6:
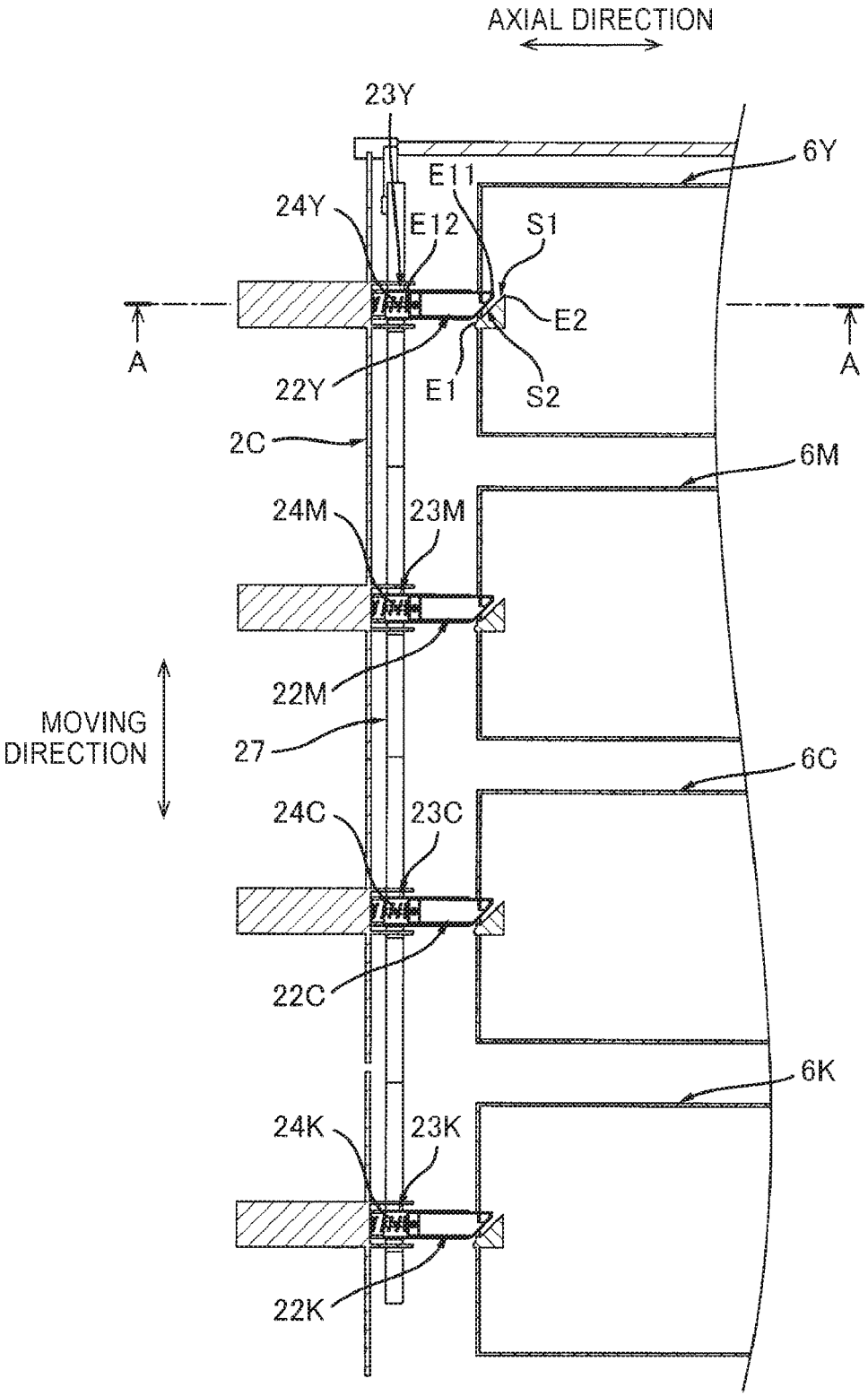
FIG. 6 is a sectional view of the image forming apparatus, taken along a line B-B of FIG. 10B.

Specifically, as shown in FIG. 6, a part of the developing cartridge 6Y is a first inclined surface S1. The first inclined surface S1 is inclined with respect to the moving direction of the drawer 4. Also, the first inclined surface S1 is inclined with respect to the axial direction. Specifically, the first inclined surface S1 has one end E1 and another end E2 in the moving direction of the drawer 4. The other end E2 is located downstream of the one end E1 with respect to a direction in which the drawer 4 is to move from the inner position toward the outer position. In the state where the drawer 4 supporting the developing cartridge 6Y is located at the inner position, the other end E2 is located more distant from the inner wall 2C than one end E1 in the axial direction. The first inclined surface S1 is more distant from the inner wall 2C from one end E1 toward the other end E2. An inclination angle of the first inclined surface S1 relative to the inner wall 2C is 10° to 80°, for example.

The supply tube 22Y has a second inclined surface S2. Specifically, the supply tube 22Y extends in the axial direction. The supply tube 22Y has a cylindrical shape. The supply tube 22Y has one end E11 and another end E12 in the axial direction. One end E11 connects to the developing cartridge 6Y in the state where the drawer 4 supporting the developing cartridge 6Y is located at the inner position and the supply tube 22Y is located at the connection position. The other end E12 is located between one end E11 and the inner wall 2C in the axial direction. The second inclined surface S2 is located at one end E11 of the supply tube 22Y in the axial direction. The second inclined surface S2 is parallel with the first inclined surface S1 in the state where the drawer 4 supporting the developing cartridge 6Y is located at the inner position and the supply tube 22Y is located at the connection position. The second inclined surface S2 faces the first inclined surface S1 in the state where the drawer 4 supporting the developing cartridge 6Y is located at the inner position and the supply tube 22Y is located at the connection position. In the case where the drawer 4 is moved from the inner position to the outer position in the state where the developing cartridge 6Y is supported by the drawer 4, the second inclined surface S2 comes into contact with the first inclined surface S1, so that the supply tube 22Y is moved from the connection position toward the non-connection position. Specifically, when the drawer 4 is moved from the inner position to the outer position in the state where the developing cartridge 6Y is supported by the drawer 4, the first inclined surface S1 comes into contact with the second inclined surface S2. Then, when the drawer 4 is further moved toward the outer position in the state where the first inclined surface S1 is in contact with the second inclined surface S2, the supply tube 22Y is pressed by the first inclined surface S1 and is thus moved from the connection position toward the non-connection position.

Figure 7:
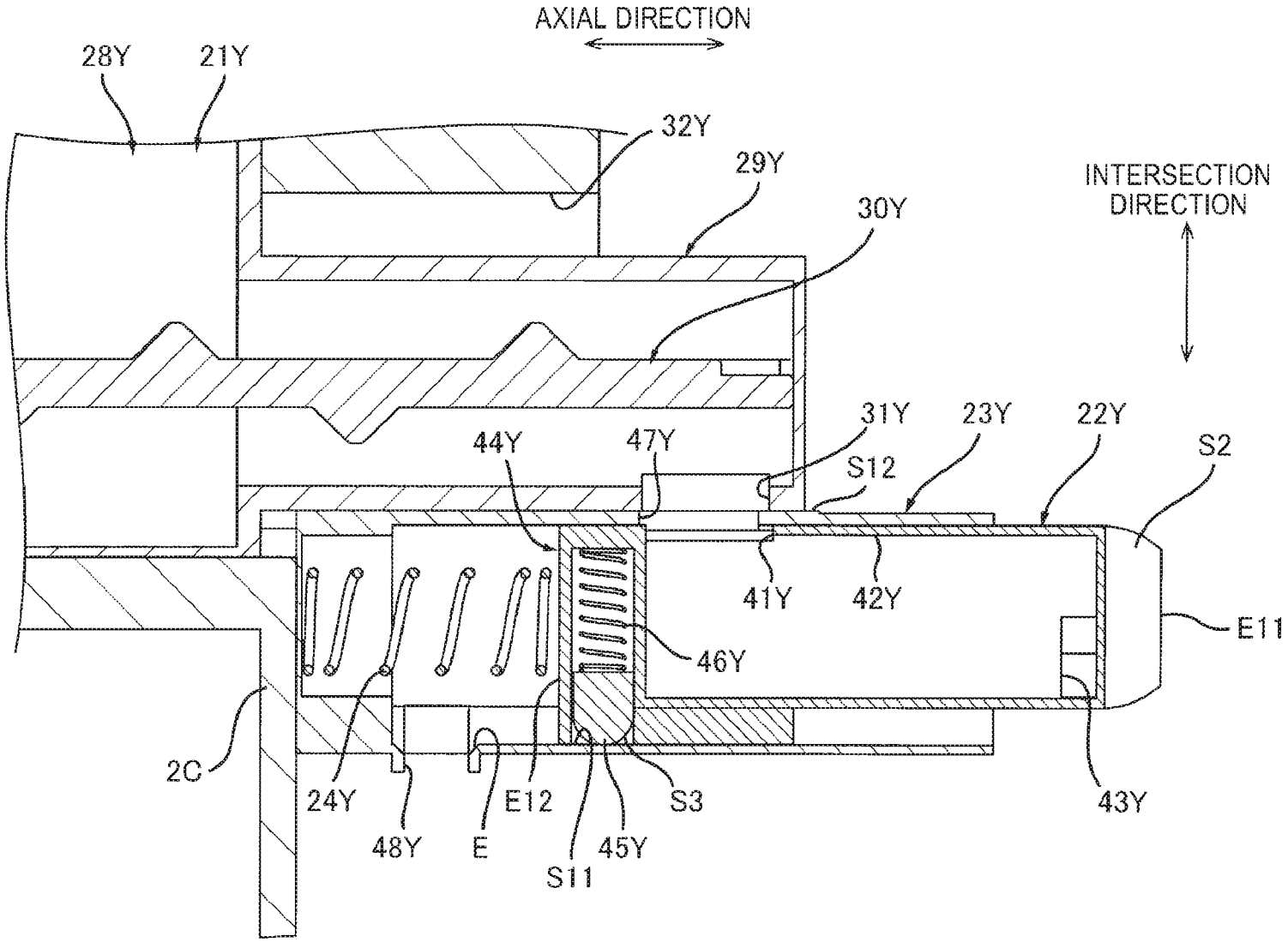
FIG. 7 illustrates locking of the supply tube to a support member, depicting a state where the supply tube is located at the connection position and a lock member is located at a lock releasing position.

As shown in FIG. 7, the supply tube 22Y includes a receiving hole 41Y, a shield wall 42Y, a supply port 43Y, a lock member accommodation part 44Y, a lock member 45Y, and a second pressing member 46Y. That is, the image forming apparatus 1 includes the lock member 45Y.

2.2.1 Receiving Hole

The receiving hole 41Y is provided at a part of a peripheral wall of the supply tube 22Y. The receiving hole 41Y is located between the lock member accommodation part 44Y and the supply port 43Y in the axial direction. The receiving hole 41Y is a through-hole. The receiving hole 41Y communicates with an internal space of the supply tube 22Y. Also, the receiving hole 41Y communicates with the discharge hole 31Y of the supply part 29Y via the communication hole 47Y of the support member 23Y in the state where the toner container 21Y is mounted to the main body housing 2 and the supply tube 22Y is located at the connection position. Thereby, the toner discharged from the discharge hole 31Y can be introduced into the receiving hole 41Y via the communication hole 47Y in the state where the supply tube 22Y is located at the connection position.

2.2.2 Shield Wall

Figure 9:
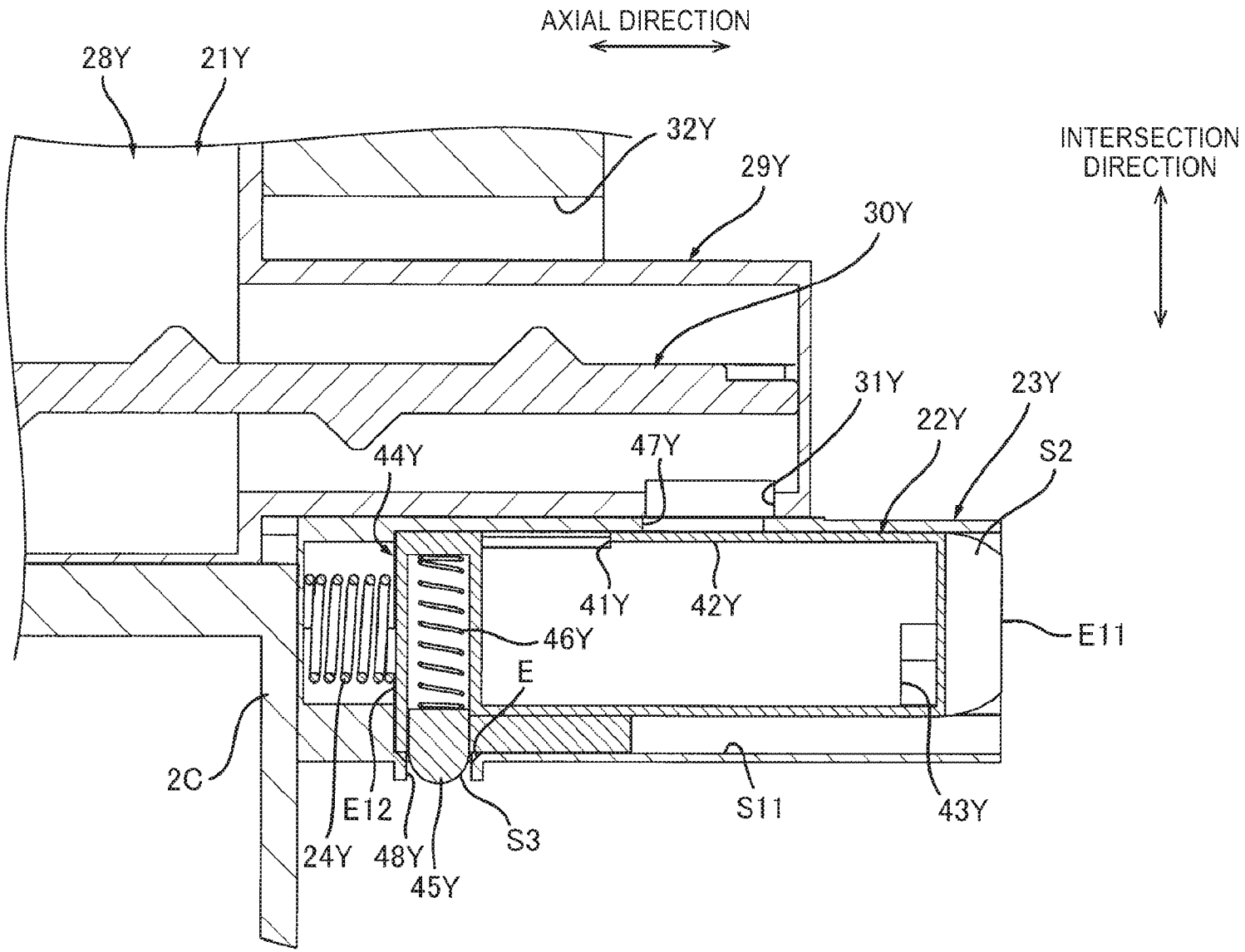
FIG. 9 illustrates locking of the supply tube to the support member together with FIGS. 7 and 8, depicting a state where the supply tube is located at the non-connection position and the lock member is located at a lock position.

The shield wall 42Y is a part of the peripheral wall of the supply tube 22Y. The shield wall 42Y is located between the receiving hole 41Y and one end E11 of the supply tube 22Y in the axial direction. As shown in FIG. 9, the shield wall 42Y is configured to shield the communication hole 47Y in the state where the supply tube 22Y is located at the non-connection position.

2.2.3 Supply Port

As shown in FIG. 7, the supply port 43Y is provided at a part of the peripheral wall of the supply tube 22Y. The supply port 43Y is spaced from the receiving hole 41Y in the axial direction. The supply port 43Y is located between the receiving hole 41Y and one end E11 of the supply tube 22Y in the axial direction. In other words, the supply port 43Y is located closer to one end E11 of the supply tube 22Y than the receiving hole 41Y in the axial direction. The supply port 43Y communicates with an internal space of the developing cartridge 6Y in the state where the supply tube 22Y is connected to the developing cartridge 6Y. Thereby, the toner in the supply tube 22Y is supplied to the developing cartridge 6Y through the supply port 43Y in the state where the supply tube 22Y is connected to the developing cartridge 6Y.

2.2.4 Lock Member Accommodation Part

The lock member accommodation part 44Y is located at the other end E12 of the supply tube 22Y. The lock member accommodation part 44Y is configured to accommodate therein the lock member 45Y. An internal space of the lock member accommodation part 44Y and the internal space of the supply tube 22Y do not communicate with each other.

2.2.5 Lock Member

The lock member 45Y is located in the lock member accommodation part 44Y. The lock member 45Y is movable in a direction of intersecting with the moving direction of the supply tube 22Y with respect to the supply tube 22Y between a lock position (see FIG. 9) and a lock releasing position (see FIG. 7). That is, the lock member 45Y is movable in a direction of intersecting with the axial direction with respect to the supply tube 22Y between the lock position and the lock releasing position. The intersection direction is preferably perpendicular to the moving direction of the supply tube 22Y. In the meantime, the moving direction of the lock member 45Y may be inclined with respect to the moving direction of the supply tube 22Y. In the exemplary embodiment, the lock member 45Y is movable in an upper and lower direction with respect to the supply tube 22Y. The lock member 45Y extends in the intersection direction. The lock member 45Y has a circular column shape. As shown in FIG. 9, the lock member 45Y is located at the lock position and is fitted in the lock hole 48Y of the support member 23Y in the state where the supply tube 22Y is located at the non-connection position. The lock hole 48Y will be described later. The lock member 45Y is fitted in the lock hole 48Y, so that the lock member 45Y locks the supply tube 22Y located at the non-connection position to the support member 23Y. That is, in the state where the lock member 45Y is located at the lock position, the lock member 45Y locks the supply tube 22Y to the support member 23Y. Also, when the lock member 45Y is located at the lock releasing position, the lock member 45Y is separated from the lock hole 48Y of the support member 23Y. The lock member 45Y is separated from the lock hole 48Y, so that the locking of the supply tube 22Y to the support member 23Y is released and the supply tube 22Y can be the moved from the non-connection position toward the connection position. That is, in the state where the lock member 45Y is located at the lock releasing position, the locking of the supply tube 22Y to the support member 23Y is released. The lock member 45Y has a curved surface S3. As shown in FIG. 7, the curved surface S3 is in contact with an inner surface S11 of the support member 23Y in the state where the supply tube 22Y is located at the connection position. The curved surface S3 is in contact with the inner surface S11 of the support member 23Y, so that the lock member 45Y is kept at the lock releasing position in the state where the supply tube 22Y is located at the connection position.

2.2.6 Second Pressing Member

The second pressing member 46Y is located in the lock member accommodation part 44Y. The second pressing member 46Y is configured to press the lock member 45Y located at the lock releasing position toward the lock position. Specifically, the second pressing member 46Y is a compression spring. The second pressing member 46Y can be expanded and contracted in the intersection direction.

Here, in the exemplary embodiment, the supply tube 22Y does not have an opening other than the receiving hole 41Y and the supply port 43Y. Further, both ends of the supply tube 22Y in the axial direction are closed. However, the supply tube 22Y does not necessarily need to satisfy both of the above-described configurations, and may satisfy only one of the above-described configurations.

2.3 Support Member

The support member 23Y protrudes from the inner wall 2C of the main body housing 2. In the meantime, the support member 23Y may be a component separate from the main body housing 2, and may be mounted to the main body housing 2. The support member 23Y extends in the axial direction and has a cylindrical shape. The supply tube 22Y is fitted in the support member 23Y. Thereby, the support member 23Y is configured to support the supply tube 22Y, and the supply tube 22Y is movable with respect to the support member 23Y. Specifically, the support member 23Y has the inner surface S11 and an outer surface S12. The inner surface S11 is configured to guide movement of the supply tube 22Y while being in contact with the supply tube 22Y in the state where the supply tube 22Y is fitted in the support member 23Y. The outer surface S12 is configured to guide mounting and demounting of the toner container 21Y to and from the main body housing 2 while being in contact with the supply part 29Y in the state where the toner container 21Y is mounted to the main body housing 2. Also, the support member 23Y has a communication hole 47Y and a lock hole 48Y.

The communication hole 47Y is provided at a part of a peripheral wall of the support member 23Y. The communication hole 47Y is a through-hole. The communication hole 47Y communicates with the discharge hole 31Y in the state where the toner container 21Y is mounted to the main body housing 2. Also, the communication hole 47Y communicates with the receiving hole 41Y in the state where the supply tube 22Y is located at the connection position. That is, the communication hole 47Y communicates with the discharge hole 31Y and the receiving hole 41Y in the state where the toner container 21Y is mounted to the main body housing 2 and the supply tube 22Y is located at the connection position. Thereby, the toner discharged from the discharge hole 31Y is introduced into the receiving hole 41Y through the communication hole 47Y.

The lock hole 48Y is provided at a part of the peripheral wall of the support member 23Y. The lock hole 48Y is a through-hole. As shown in FIG. 9, in the state where the supply tube 22Y is located at the non-connection position, the lock member 45Y located at the lock position is fitted in the lock hole 48Y. The lock member 45Y is fitted in the lock hole 48Y, so that the supply tube 22Y is located at the non-connection position. Specifically, as shown in FIGS. 7 and 8, in the case where the drawer 4 is moved from the inner position to the outer position in the state where the developing cartridge 6Y is supported by the drawer 4, the supply tube 22Y comes into contact with a part of the developing cartridge 6Y, specifically, the first inclined surface S1 (see FIG. 6), so that the supply tube 22Y is moved from the connection position (see FIG. 7) to an intermediate position (see FIG. 8) between the connection position and the non-connection position.

Figure 8:
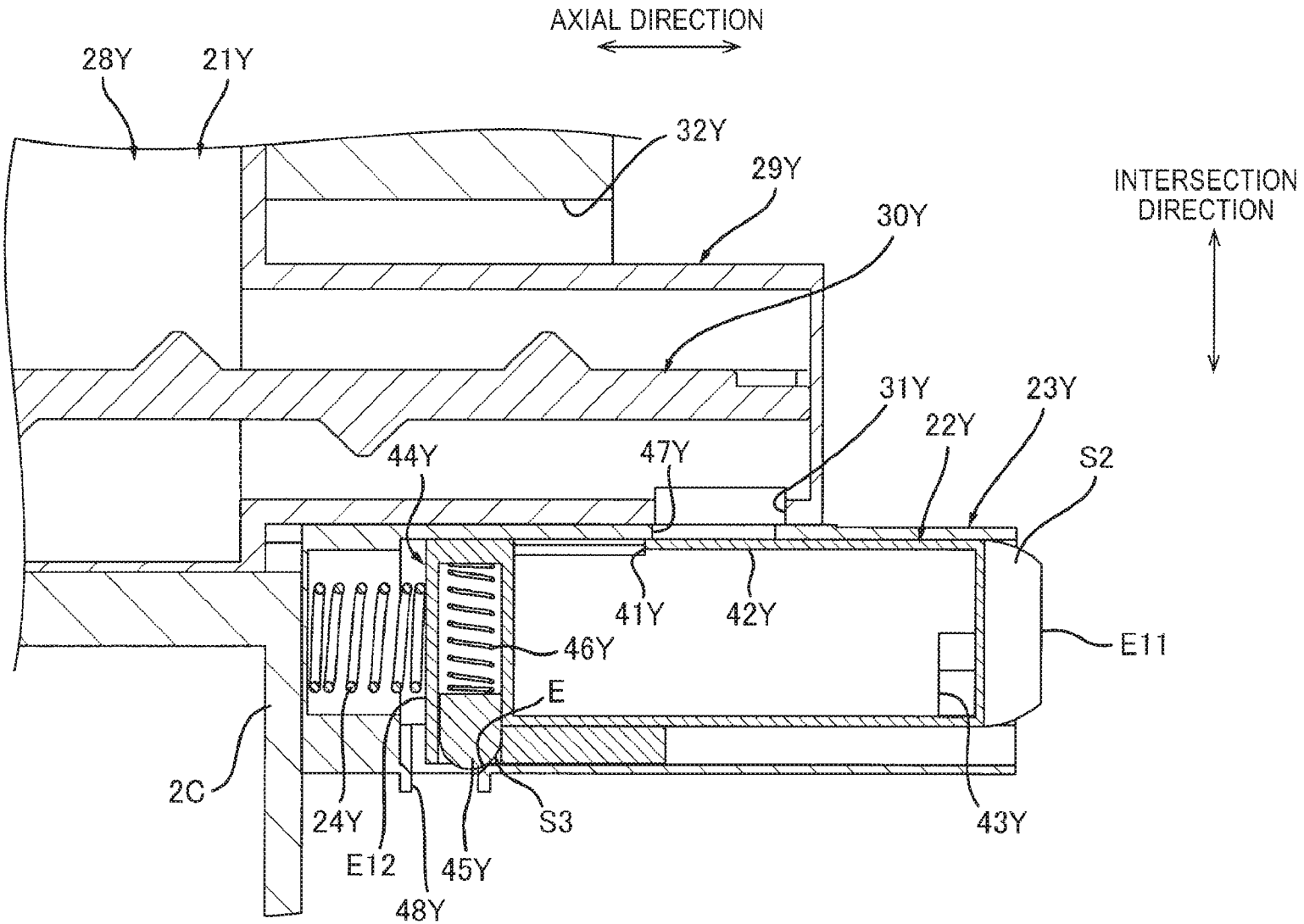
FIG. 8 illustrates locking of the supply tube to the support member together with FIG. 7, depicting a state where the supply tube is located at an intermediate position and the lock member is in contact with an edge of a lock hole.

Then, as shown in FIG. 8, the curved surface S3 of the lock member 45Y comes into contact with an edge E of the lock hole 48Y. Here, it is preferable that the edge E of the lock hole 48Y is chamfered. The lock member 45Y is not fitted in the lock hole 48Y and is not located at the lock releasing position in the state where the curved surface S3 is in contact with the edge E. In the exemplary embodiment, the lock member 45Y is located between the lock releasing position and the lock position.

When the curved surface S3 comes into contact with the edge E, the lock member 45Y is pressed from the lock releasing position toward the lock position by the second pressing member 46Y, so that the lock member 45Y is guided to the lock hole 48Y, as shown in FIGS. 8 and 9. At this time, the lock member 45Y is fitted in the lock hole 48Y while being moved in a direction of getting away from the developing cartridge 6Y in the axial direction. Then, the supply tube 22Y is moved in a direction of getting away from the developing cartridge 6Y in the axial direction against the pressing force of the pressing member 24Y. Thereby, the supply tube 22Y is moved from the intermediate position to the non-contact position. That is, the curved surface S3 comes into contact with the edge E of the lock hole 48Y, so that the supply tube 22Y is moved from the intermediate position to the non-connection position.

Then, as shown in FIGS. 5 and 9, when the supply tube 22Y is located at the non-connection position, the supply tube 22Y is spaced from the developing cartridge 6Y (see FIG. 5) in the axial direction. In other words, in the state where the supply tube 22Y is located at the non-connection position, the supply tube 22Y is located at a position that does not overlap a moving locus, in the moving direction, of the developing cartridge 6Y supported by the drawer 4. Thereby, the supply tube 22Y located at the non-connection position is not in contact with the developing cartridge 6Y in a case where the drawer 4 supporting the developing cartridge 6Y is moved from the outer position toward the inner position.

2.4 Pressing Member

As shown in FIG. 9, the pressing member 24Y is located at an interior space of the support member 23Y. The pressing member 24Y is configured to press the supply tube 22Y located at the non-connection position toward the connection position. Specifically, the pressing member 24Y is a compression spring. The pressing member 24Y can be expanded and contracted in the axial direction. In the meantime, the pressing member 24Y may be expanded and contracted in a direction inclined with respect to the axial direction.

2.5 Lock Releasing Member

The lock releasing member 25Y shown in FIG. 10A is a member for pressing the lock member 45Y (see FIG. 9) located at the lock position toward the lock releasing position. Specifically, the lock releasing member 25Y is movable between a spaced position (see FIG. 10A) and a pressing position (see FIG. 10B) in a direction in which the lock member 45Y is to move. That is, the lock releasing member 25Y is movable in a direction of intersecting with the axial direction. In the exemplary embodiment, the lock releasing member 25Y is movable in the upper and lower direction. The lock releasing member 25Y extends in the moving direction of the lock releasing member 25Y. In other words, the lock releasing member 25Y extends in the intersection direction. In the exemplary embodiment, the lock releasing member 25Y extends in the upper and lower direction. The lock releasing member 25Y has a rod shape.

As shown in FIG. 10A, the lock releasing member 25Y located at the spaced position is spaced from the support member 23Y. In this state, the lock releasing member 25Y located at the spaced position is spaced from the lock member 45Y (see FIG. 9) located at the lock position. The lock releasing member 25Y located at the spaced position faces the lock member 45Y located at the lock position. In the exemplary embodiment, the lock releasing member 25Y located at the spaced position is located below the lock member 45Y located at the lock position.

Figure 10B:
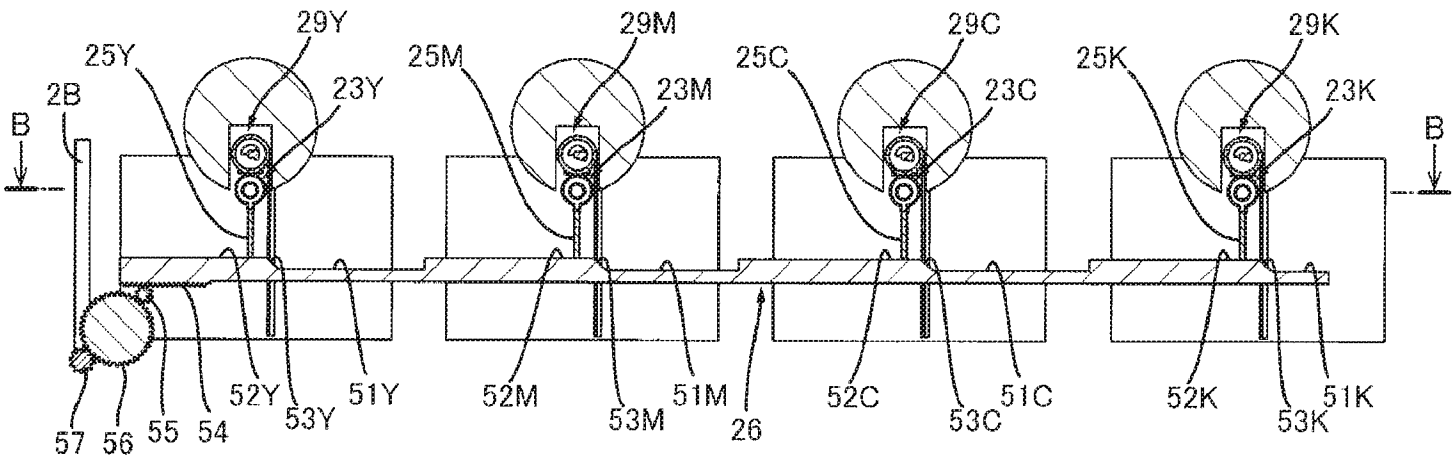
FIG. 10B illustrates interlocking of the cover and the lock releasing member together with FIG. 10A, depicting a state where the cover is located at a closing position, the cam is located at a second position and the lock releasing member is located at a pressing position.

Also, as shown in FIG. 10B, the lock releasing member 25Y located at the pressing position presses the lock member 45Y (see FIG. 9) located at the lock position toward the lock releasing position. Thereby, the lock member 45Y is moved from the lock position toward the lock releasing position, against the pressing force of the second pressing member 46Y (see FIG. 9). Then, the locking of the supply tube 22Y to the support member 23Y is released, so that the supply tube 22Y is moved from the non-connection position toward the connection position by the pressing force of the pressing member 24Y.

2.6 Cam

As shown in FIGS. 10A and 10B, the cam 26 is movable in conjunction with movement of the cover 2B. Specifically, the cam 26 is movable in the moving direction of the drawer 4 between a first position (see FIG. 10A) and a second position (see FIG. 10B). The cam 26 located at the first position locates the lock releasing member 25Y at the spaced position. The cam 26 located at the second position locates the lock releasing member 25Y at the pressing position. The cam 26 is located at the first position in the state where the cover 2B is located at the opening position, and is located at the second position in the state where the cover 2B is located at the closing position.

More specifically, the cam 26 extends in the moving direction of the drawer 4, and has four planar surfaces 51Y, 51M, 51C, 51K, four planar surfaces 52Y, 52M, 52C, 52K, four inclined surfaces 53Y, 53M, 53C, 53K, and a rack gear 54.

The four planar surfaces 51Y, 51M, 51C, 51K are aligned side by side in the moving direction of the cam 26. The four planar surfaces 51Y, 51M, 51C, 51K are respectively spaced from each other in the moving direction of the cam 26. The four planar surfaces 51Y, 51M, 51C, 51K extend in the moving direction of the cam 26, respectively. In a case where the cam 26 is located at the first position, the planar surface 51Y faces the lock releasing member 25Y located at the spaced position, the planar surface 51M faces the lock releasing member 25M located at the spaced position, the planar surface 51C faces the lock releasing member 25C located at the spaced position, and the planar surface 51K faces the lock releasing member 25K located at the spaced position.

The four planar surfaces 52Y, 52M, 52C, 52K are aligned side by side in the moving direction of the cam 26. The four planar surfaces 52Y, 52M, 52C, 52K are respectively spaced from each other in the moving direction of the cam 26. The planar surface 52Y is located at an opposite side to the planar surface 52M with respect to the planar surface 51Y, in the moving direction of the cam 26. The planar surface 52M is located between the planar surface 51Y and the planar surface 51M in the moving direction of the cam 26. The planar surface 52C is located between the planar surface 51M and the planar surface 51C in the moving direction of the cam 26. The planar surface 52K is located between the planar surface 51C and the planar surface 51K in the moving direction of the cam 26. Also, the four planar surfaces 52Y, 52M, 52C, 52K are located above the four planar surfaces 51Y, 51M, 51C, 51K. The four planar surfaces 52Y, 52M, 52C, 52K extend in the moving direction of the cam 26, respectively. In a case where the cam 26 is located at the second position, the planar surface 52Y comes into contact with the lock releasing member 25Y located at the pressing position, the planar surface 52M comes into contact with the lock releasing member 25M located at the pressing position, the planar surface 52C comes into contact with the lock releasing member 25C located at the pressing position, and the planar surface 52K comes into contact with the lock releasing member 25K located at the pressing position.

The four inclined surfaces 53Y, 53M, 53C, 53K are aligned side by side in the moving direction of the cam 26. The four inclined surfaces 53Y, 53M, 53C, 53K are respectively spaced from each other in the moving direction of the cam 26. The inclined surface 53Y is located between the planar surface 51Y and the planar surface 52Y in the moving direction of the cam 26. The inclined surface 53Y is inclined with respect to the planar surface 51Y and the planar surface 52Y. The inclined surface 53Y connects to the planar surface 51Y and the planar surface 52Y. The inclined surface 53M is located between the planar surface 51M and the planar surface 52M in the moving direction of the cam 26. The inclined surface 53M is inclined with respect to the planar surface 51M and the planar surface 52M. The inclined surface 53M connects to the planar surface 51M and the planar surface 52M. The inclined surface 53C is located between the planar surface 51C and the planar surface 52C in the moving direction of the cam 26. The inclined surface 53C is inclined with respect to the planar surface 51C and the planar surface 52C. The inclined surface 53C connects to the planar surface 51C and the planar surface 52C. The inclined surface 53K is located between the planar surface 51K and the planar surface 52K in the moving direction of the cam 26. The inclined surface 53K is inclined with respect to the planar surface 51K and the planar surface 52K. The inclined surface 53K connects to the planar surface 51K and the planar surface 52K. In a case where the cam 26 is moved between the first position and the second position, the inclined surface 53Y comes into contact with the lock releasing member 25Y, the inclined surface 53M comes into contact with the lock releasing member 25M, the inclined surface 53C comes into contact with the lock releasing member 25C, and the inclined surface 53K comes into contact with the lock releasing member 25K.

The rack gear 54 is located at a part of the cam 26 in the moving direction. The rack gear 54 is connected to the cover 2B via a plurality of idle gears 55, 56, 57. Thereby, the cam 26 can move in conjunction with movement of the cover 2B.

3. Mounting and Demounting of Developing Cartridge

Subsequently, mounting and demounting of the developing cartridge 6Y are described with reference to FIGS. 1 to 10B. In the meantime, since descriptions of mounting and demounting of the developing cartridges 6M, 6C, 6K are the same as the description of mounting and demounting of the developing cartridge 6Y, the descriptions are omitted.

In a case of demounting the developing cartridge 6Y from the image forming apparatus 1, a user locates the cover 2B at the opening position, as shown in FIG. 3. Thereby, as shown in FIG. 10A, the cam 26 is located at the first position and the lock releasing member 25Y is located at the spaced position.

Then, as shown in FIG. 2, the user pulls out the drawer 4 from the inner position to the outer position. At this time, as shown in FIGS. 7 and 8, the supply tube 22Y comes into contact with a part of the developing cartridge 6Y, specifically, the first inclined surface S1 (see FIG. 6), so that the supply tube 22Y is moved from the connection position (see FIG. 7) to the intermediate position (see FIG. 8). Thereafter, as shown in FIGS. 8 and 9, the lock member 45Y is guided to the lock hole 48Y, so that the supply tube 22Y is moved from the intermediate position (see FIG. 8) to the non-connection position (see FIG. 9). The lock member 45Y is fitted in the lock hole 48Y, so that the supply tube 22Y located at the non-connection position is locked to the support member 23Y. The supply tube 22Y is located at the non-connection position, so that the supply tube 22Y is spaced from the developing cartridge 6Y, as shown in FIG. 5.

Then, the user demounts the developing cartridge 6Y from the drawer 4 (see FIG. 2) located at the outer position. Thereby, the demounting of the developing cartridge 6Y from the image forming apparatus 1 is completed.

Also, in a case of mounting the developing cartridge 6Y to the image forming apparatus 1, the user mounts the developing cartridge 6Y to the drawer 4 located at the outer position in the state where the cover 2B is located at the opening position.

Then, the user pushes the drawer 4 from the outer position to the inner position (see FIG. 1). At this time, the supply tube 22Y is locked to the support member 23Y while being located at the non-connection position. For this reason, when the drawer 4 is moved from the outer position to the inner position, the developing cartridge 6Y does not come into contact with the supply tube 22Y.

Then, as shown in FIGS. 10A and 10B, the user moves the cover 2B from the opening position to the closing position in the state where the drawer 4 is located at the inner position. Thereby, the cam 26 is moved from the first position to the second position in conjunction with the movement of the cover 2B from the opening position to the closing position. When the cam 26 is located at the second position, the lock releasing member 25Y is located at the pressing position, as shown in FIG. 10B.

Thereby, the lock member 45Y is located at the lock releasing position, and the supply tube 22Y is moved from the non-connection position (see FIG. 9) to the connection position (see FIG. 7) by the pressing force of the pressing member 24Y, as shown in FIGS. 9 and 7.

When the supply tube 22Y is located at the connection position, the supply tube 22Y is connected to the developing cartridge 6Y, as shown in FIG. 4. Thereby, the mounting of the developing cartridge 6Y to the image forming apparatus 1 is completed, so that the supply tube 22Y can supply the toner from the toner container 21Y to the developing cartridge 6Y.

4. Operational Effects (1) According to the image forming apparatus 1, as shown in FIG. 4, in a case where the drawer 4 supporting the developing cartridge 6Y is located at the inner position and the supply tube 22Y is located at the connection position, the toner can be supplied from the toner container 21Y to the developing cartridge 6Y through the supply tube 22Y in the state where the supply tube 22Y is connected to the developing cartridge 6Y.

For this reason, it is possible to suppress the toner, which is to be supplied from the toner container 21Y to the developing cartridge 6Y, from being spilled out.

Also, as shown in FIGS. 7 and 9, in a case where the drawer 4 is moved from the inner position to the outer position in the state where the developing cartridge 6Y is supported by the drawer 4, the supply tube 22Y can be moved from the connection position to the non-connection position.

For this reason, the user does not need to individually perform the operation of moving the supply tube 22Y from the connection position to the non-connection position and the operation of moving the drawer 4 from the inner position to the outer position, and can move the supply tube 22Y from the connection position to the non-connection position in conjunction with the operation of moving the drawer 4 from the inner position to the outer position.

As a result, it is possible to smoothly perform the operations of mounting and demounting the developing cartridge 6Y to and from the image forming apparatus 1.

(2) Also, according to the image forming apparatus 1, as shown in FIG. 9, it is possible to lock the supply tube 22Y located at the non-connection position to the support member 23Y.

As a result, it is possible to suppress the supply tube 22Y from returning from the non-connection position to the connection position at the user's unintended timing.

(3) Also, according to the image forming apparatus 1, as shown in FIG. 9, it is possible to lock the supply tube 22Y to the support member 23Y by the simple configuration of fitting the lock member 45Y in the lock hole 48Y of the support member 23Y.

(4) Also, according to the image forming apparatus 1, as shown in FIGS. 8 and 9, it is possible to move and lock the supply tube 22Y to the non-connection position (see FIG. 9) which does not overlap the moving locus, in the moving direction, of the developing cartridge 6Y supported by the drawer 4, by the simple configuration of providing the lock member 45Y with the curved surface S3.

Thereby, when the drawer 4 supporting the developing cartridge 6Y is moved between the inner position and the outer position, it is possible to prevent the developing cartridge 6Y from coming into contact with the supply tube 22Y.

(5) Also, according to the image forming apparatus 1, as shown in FIG. 10A, in the state where the cover 2B is located at the opening position, the lock releasing member 25Y is spaced from the lock member 45Y (see FIG. 9) located at the lock position.

For this reason, in a case where the cover 2B is moved from the closing position to the opening position in the state where the drawer 4 is located at the inner position, the supply tube 22Y does not move from the connection position.

Thereby, in a case where the user moves the cover 2B from the closing position to the opening position even though it is not necessary to locate the drawer 4 at the outer position, it is possible to prevent the supply tube 22Y from being located at the non-connection position.

As a result, it is possible to suppress the user from unintentionally locating the supply tube 22Y at the non-connection position, and to suppress the toner from being leaked.

Also, as shown in FIG. 10B, in the state where the cover 2B is located at the closing position, the lock releasing member 25Y presses the lock member 45Y (see FIG. 9) located at the lock position toward the lock releasing position.

Thereby, it is possible to move the lock member 45Y to the lock releasing position in conjunction with the movement of the cover 2B from the opening position to the closing position.

As a result, it is possible to move the supply tube 22Y from the non-connection position to the connection position in the state where the drawer 4 supporting the developing cartridge 6Y is located at the inner position.

(6) Also, according to the image forming apparatus 1, as shown in FIG. 7, the support member 23Y has the inner surface S11 in contact with the supply tube 22Y and the outer surface S12 in contact with the supply part 29Y of the toner container 21Y in the state where the toner container 21Y is mounted to the main body housing 2.

For this reason, it is possible to guide the movement of the supply tube 22Y by the inner surface S11 of the support member 23Y and to guide the mounting and demounting of the toner container 21Y to and from the main body housing 2 by using the outer surface S12 of the support member 23Y.

(7) Also, according to the image forming apparatus 1, as shown in FIG. 9, it is possible to block the introduction of the toner from the toner container 21Y into the supply tube 22Y by using the shield wall 42Y of the supply tube 22Y.

(8) Also, according to the image forming apparatus 1, as shown in FIG. 6, with the simple configuration where the developing cartridge 6Y and the supply tube 22Y are respectively provided with the inclined surfaces (the first inclined surface S1, the second inclined surface S2), it is possible to move the supply tube 22Y from the connection position toward the non-connection position in the case where the drawer 4 is moved from the inner position to the outer position in the state where the developing cartridge 6Y is supported by the drawer 4.

(9) Also, according to the image forming apparatus 1, in the configuration where the image forming apparatus 1 includes the four developing cartridges 6Y, 6M, 6C, 6K, it is possible to suppress the toner which is to be supplied from the toner container 21Y to the developing cartridge 6Y from being spilled out, the toner which is to be supplied from the toner container 21M to the developing cartridge 6M from being spilled out, the toner which is to be supplied from the toner container 21C to the developing cartridge 6C from being spilled out, and the toner which is to be supplied from the toner container 21K to the developing cartridge 6K from being spilled out, and to smoothly perform the respective operations of mounting and demounting the developing cartridges 6Y, 6M, 6C, 6K to and from the main body housing 2.

Also, according to the image forming apparatus 1, in a case where the drawer 4 is moved from the inner position to the outer position in the state where the four developing cartridges 6Y, 6M, 6C, 6K are supported by the drawer 4, the four supply tubes 22Y, 22M, 22C, 22K are respectively moved and locked to the non-contact position.

For this reason, when the drawer 4 is moved between the inner position and the outer position, it is possible to prevent each of the developing cartridges 6Y, 6M, 6C, 6K from coming into contact with each of the supply tubes 22Y, 22M, 22C, 22K.

5. Modified Embodiments

In the exemplary embodiment, the developing cartridge 6Y accommodates therein the toner in the non-use state, and the toner container 21Y supplies the toner to the developing cartridge 6Y. However, the toner container 21Y may include the developing roller 11Y and may supply the toner to the developing device in which the toner is not accommodated, in the non-use state.

Also, in the exemplary embodiment, the image forming apparatus 1 including the four developing cartridges 6Y, 6M, 6C, 6K and capable of performing a multi-color printing has been exemplified. However, the image forming apparatus may be an image forming apparatus dedicated for single color printing including one developing cartridge 6K.

What is claimed is:

1. An image forming apparatus comprising:

a main body housing;

a drawer movable in a moving direction between an inner position located inside the main body housing and an outer position located outside the main body housing;

a developing cartridge configured to be detachably supported by the drawer and including a developing roller;

a toner container capable of accommodating therein toner; and a supply tube configured to supply the toner from the toner container to the developing cartridge when the developing cartridge is supported by the drawer and the drawer is located at the inner position wherein when the developing cartridge is supported by the drawer and the drawer is located at the inner position, the supply tube is movable between a connection position at which the supply tube is connected to the developing cartridge and a non-connection position at which the supply tube is not connected to the developing cartridge, and wherein the supply tube is configured to be locked relative to the main body when the supply tube is located at the non-connection position.

2. The image forming apparatus according to claim 1, further comprising:

a support member supporting the supply tube, the supply tube being movable with respect to the support member;

a pressing member configured to press the supply tube located at the non-connection position toward the connection position; and a lock member configured to lock the supply tube located at the non-connection position to the support member and being movable, in a direction of intersecting with a moving direction of the supply tube, between a lock position at which the supply tube is locked to the support member and a lock releasing position at which locking of the supply tube to the support member is released.

3. The image forming apparatus according to claim 2, wherein the supply tube includes the lock member and a second pressing member configured to press the lock member located at the lock releasing position toward the lock position, and wherein the support member has a lock hole in which the lock member located at the lock position is fitted in a state where the supply tube is located at the non-connection position.

4. The image forming apparatus according to claim 3, wherein the lock member has a curved surface that is in contact with the support member in a state where the supply tube is located at the connection position, wherein in the case where the drawer is moved from the inner position to the outer position in the state where the developing cartridge is supported by the drawer, the supply tube comes into contact with a part of the developing cartridge and is thus moved from the connection position to an intermediate position between the connection position and the non-connection position, and the curved surface comes into contact with an edge of the lock hole and the supply tube is thus moved from the intermediate position to the non-connection position, and wherein in a state where the supply tube is located at the non-connection position, the supply tube is located at a position that does not overlap a moving locus, in the moving direction, of the developing cartridge supported by the drawer.

5. The image forming apparatus according to claim 3, wherein the lock hole is a through-hole, wherein the main body housing has an opening through which the drawer is to pass, and a cover movable between an opening position at which the cover opens the opening and a closing position at which the cover closes the opening, and wherein the image forming apparatus further comprises:

a lock releasing member movable between a spaced position at which the lock releasing member is spaced from the lock member located at the lock position and a pressing position at which the lock releasing member presses the lock member located at the lock position toward the lock releasing position, and a cam movable in conjunction with movement of the cover, and being located at a first position at which the lock releasing member is located at the spaced position in a state where the cover is located at the opening position and being located at a second position at which the lock releasing member is located at the pressing position in a state where the cover is located at the closing position.

6. The image forming apparatus according to claim 3, wherein the support member has a cylindrical shape protruding from an inner wall of the main body housing and has a peripheral wall, and wherein the lock hole is provided at the peripheral wall.

7. The image forming apparatus according to claim 2, wherein the support member has a cylindrical shape protruding from an inner wall of the main body housing, and has an inner surface configured to guide movement of the supply tube while being in contact with the supply tube and an outer surface configured to guide mounting and demounting of the toner container to and from the main body housing while being in contact with the toner container.

8. The image forming apparatus according to claim 2, wherein the toner container includes:

an accommodation part located outside the main body housing in a state where the toner container is mounted to the main body housing and configured to accommodate therein the toner, and a supply part located inside the main body housing in a state where the toner container is mounted to the main body housing and configured to supply the toner accommodated in the accommodation part to the supply tube.

9. The image forming apparatus according to claim 8, wherein the supply part has a discharge hole through which the toner accommodated in the accommodation part is to be discharged, wherein the support member has a communication hole communicating with the discharge hole in a state where the toner container is mounted to the main body housing, and wherein the supply tube has a receiving hole into which the toner discharged from the discharge hole is to be introduced via the communication hole in a state where the supply tube is located at the connection position, and a shield wall configured to shield the communication hole in a state where the supply tube is located at the non-connection position.

10. The image forming apparatus according to claim 1, wherein the lock member has a circular column shape.

11. The image forming apparatus according to claim 1, wherein in a case where the drawer is moved from the inner position to the outer position in a state where the developing cartridge is supported by the drawer, the supply tube comes into contact with a part of the developing cartridge and is thus moved from the connection position to the non-connection position.

12. An image forming apparatus comprising:

a main body housing;

a drawer movable in a moving direction between an inner position located inside the main body housing and an outer position located outside the main body housing;

a developing cartridge configured to be detachably supported by the drawer and including a developing roller;

a toner container capable of accommodating therein toner;

a supply tube configured to supply the toner from the toner container to the developing cartridge when the developing cartridge is supported by the drawer and the drawer is located at the inner position; and a support member configured to support the supply tube, wherein the supply tube is movable relative to the support member between a projection position at which the supply tube is projected from the support member and a retract position at which the supply tube is retracted within the support member, and wherein the supply tube is configured to be locked relative to the main body when the supply tube is located at the retract position.

* * * * *